United States Patent [19]

Grayson

[11] 4,256,157

[45] Mar. 17, 1981

[54] NUT, BOLT, AND SCREW HOLDER

[76] Inventor: Robert E. Grayson, Rt. 2 S. Box 699, Great Falls, Mont. 59405

[21] Appl. No.: 88,477

[22] Filed: Oct. 26, 1979

[51] Int. Cl.[3] ..... B25C 3/00

[52] U.S. Cl. ..... 145/46

[58] Field of Search ..... 145/46

[56] References Cited

U.S. PATENT DOCUMENTS

| | | | |
|---|---|---|---|
| 1,174,887 | 3/1916 | Meriwether | 145/46 |
| 2,348,962 | 5/1944 | Davis | 145/46 |
| 2,420,869 | 5/1947 | Davis | 145/46 |
| 2,491,860 | 12/1949 | Ingraham | 145/46 |
| 2,765,828 | 10/1956 | Leniz | 145/46 |
| 3,729,035 | 4/1973 | Manzanarez | 145/46 |
| 3,913,646 | 10/1975 | Grayson | 145/46 |

*Primary Examiner*—Othell M. Simpson
*Assistant Examiner*—J. T. Zatarga
*Attorney, Agent, or Firm*—Matthew L. Ajeman

[57] ABSTRACT

A nut, bolt, and screw holder arrangeable on a finger of a user of the holder has a support arrangement disposed for engaging with a finger of the user along a longitudinal extent of the finger. A holding assembly is mounted on the support arrangement for selectively engaging an item, or items, to be held and retaining the item on the support arrangement. The support arrangement includes a longitudinal extending member, and a finger engaging structure provided on the member for cooperatively engaging with an associated finger and removably retaining the member on the finger. The longitudinally extending member includes a first end and a second end spaced from the first end, with the holding arrangement being disposed on the member at the first end of the member. The finger engaging structure includes a ring pivotally mounted on the member adjacent the second end of the member, with the ring being arranged for receiving a finger on which the holder is to be mounted.

17 Claims, 10 Drawing Figures

FIG. 1
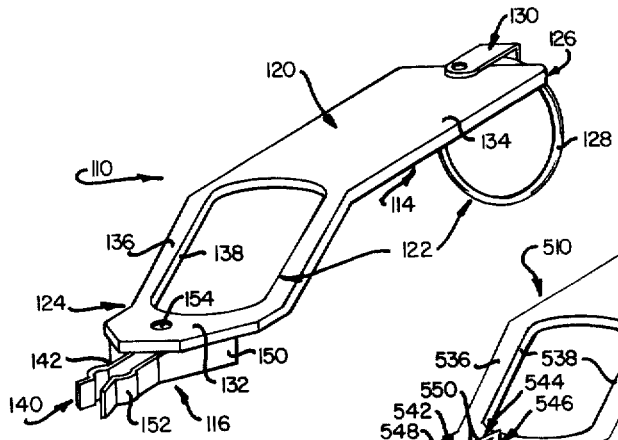
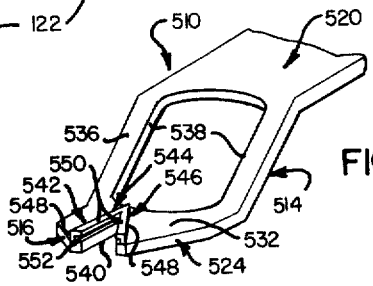
FIG.7
FIG.2
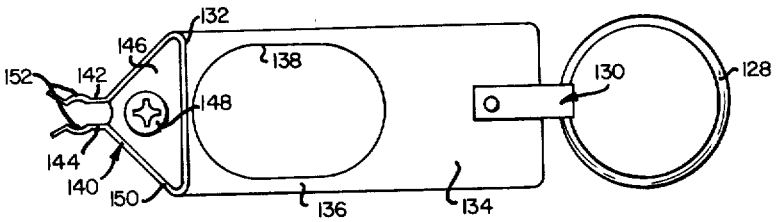
FIG.3
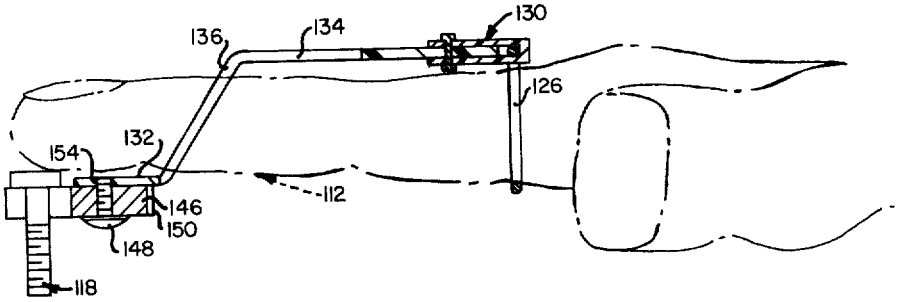
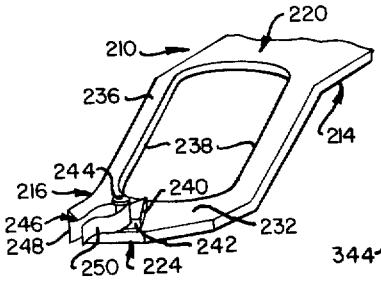
FIG.4
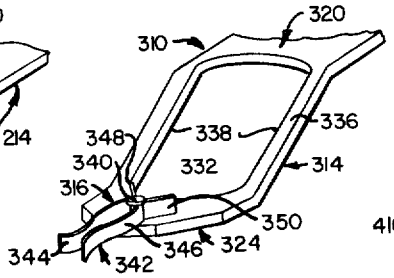
FIG.5
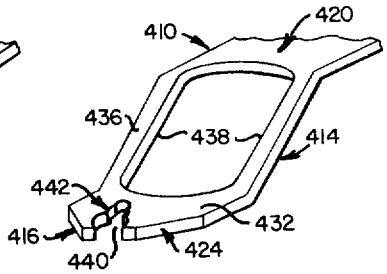
FIG.6

FIG.8
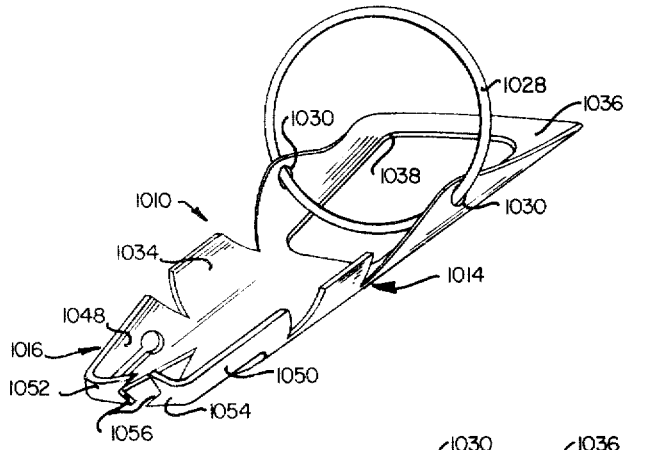
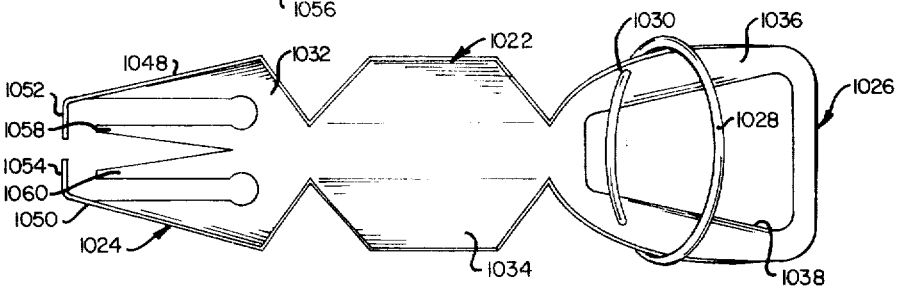
FIG.9
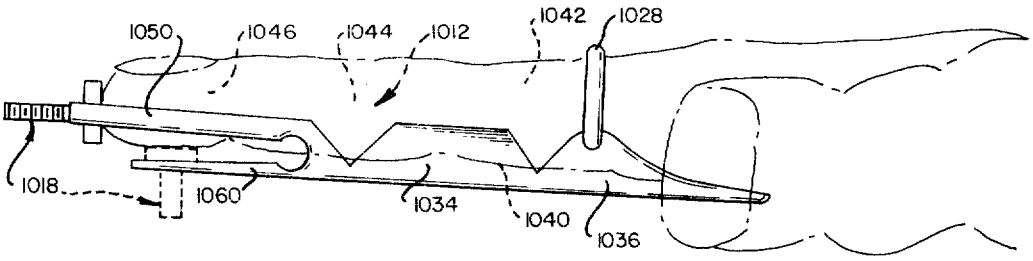
FIG.10

NUT, BOLT, AND SCREW HOLDER

This invention relates generally to finger-manipulated tools, and particularly to a finger mounted nut, bolt and screw holder.

DESCRIPTION OF THE PRIOR ART

A difficulty encountered in the assembly and maintenance of mechanical equipment is that many bolts, screws, nuts and the like, are disposed in hard-to-get places. As a result, many devices have been proposed for assisting assemblers, mechanics, and repairmen in properly positioning and holding fasteners in such inaccessible locations. My prior U.S. Pat. No. 3,913,646, issued Oct. 21, 1975, discloses a finger tip nut and bolt holding tool having a thimble-like support member on which are mounted one or more holding devices. The holding devices include a combination of magnets and wire clips disposed on the tools in such a manner as to permit the accomplishment of a wide range of various nut and bolt holding tasks.

SUMMARY OF THE INVENTION

It is the object of the present invention to provide a nut, bolt and screw holder which uses an entire finger for support, while simultaneously using the entire finger to exactly position a holding portion of the holding device.

It is another object of the present invention to provide a nut bolt and screw holder which permits exact positioning while retaining a wide variety of bolts, nuts, screws, and other appropriate fasteners.

These and other objects are achieved according to the present invention by providing a tool having: a support arrangement for engaging with an associated finger along a longitudinal extent of the finger; and a holding arrangement mounted on the support arrangement for selectively engaging an item, such as a nut, bolt, screw, and the like, and retaining the item on the support arrangement.

The support arrangement includes a longitudinally extending member, and a finger engaging structure provided on the member for cooperatively engaging with an associated finger and removably retaining the member on the finger. The longitudinal extending member preferably includes a first end and a second end spaced logitudinally from the first end, with the holding arrangement being arranged on the member at the first end. The finger engaging structure advantageously includes a ring pivotally mounted on the member adjacent the second end of the member, with the ring being arranged for receiving a finger on which the holder is to be mounted.

According to a first preferred embodiment of the present invention, the longitudinal extending member includes a first planar portion and a second planar portion, each planar portion lying in a respective plane parallel to but spaced from the plane of the other portion. A web connects the first portion to the second portion, with the web arranged adjacent to the first end of the longitudinal extending member and being provided with a finger-receiving opening. The holding arrangement is attached to the first planar portion, with the ring being connected to and arranged for extending away from the second planar portion toward the plane of the first planar portion.

The holding arrangement of the first embodiment of a holder according to the present invention preferably includes a substantially U-shaped resilient clip comprising a pair of spaced, substantially parallel, coextensive legs arranged for gripping between them an item to be held. The clip can have a back portion enlarged to pass around the periphery of a piece of solid magnetic material connected to the first end of the longitudinal extending member, with the legs of the clip being arranged extending away from the longitudinally extending member in a direction parallel to the longitudinal extent of the member. The clip can be mounted either flush with an adjacent surface of the first planar portion of the associated member, or can be disposed in a recess provided in the adjacent surface of the member. Further, extensions can be provided on each leg of the clip so as to permit the legs of the clip to be drawn away from one another by forcing the extensions toward one another by one's fingers, and the like.

Alternatively, the holding arrangement can include a notch provided in the first end of the longitudinal extending member, with this notch lying in the plane of the first portion of the member and being substantially V-shaped and opening divergently toward the first end of the member for receiving an item to be held. This notch can include a plurality of sets of concentric, opposed arcs whose radius increases toward the opening of the notch, and/or the notch can have associated therewith a guideway forming a T-shaped chamber in transverse section in cooperation with the notch.

According to a second preferred embodiment of the present invention, the longitudinally extending member includes a first concave portion, a second concave portion, and a third concave portion disposed between and connecting together the first and second portions. The holding arrangement in this embodiment is provided on the first portion, with the ring being provided on the second portion.

The longitudinally extending member is rigid, and, due to the concave portions, has a curved cross section perpendicular to the longitudinal extending member for conformingly engaging with a lower surface portion of an associated finger, the member being thus contoured longitudinally to the finger. The second portion of the longitudinally extending member is flared away from the longitudinal extending member and is engageable with the first phalanx of the finger proceeding distally, with the third portion of the member engageable with a second phalanx, and the first portion of the member being engageable with a third phalanx of the associated finger.

The holding arrangement of the second embodiment advantageously includes a pair of arms extending longitudinally of the longitudinal extent of the longitudinal extending member, each of the arms terminating in a tip exposed transversely up the longitudinal extent of the member and towards the tip of the arms. The tips each terminate in a V-shaped indentation opening toward the tip of the other of the arms for receiving an item, such as a bolt or screw shank, between them while also permitting reception therebetween of other shaped items, such as rectangular and hexagonal nuts, not shown. A pair of coextensive projections extending codirectionally with and disposed between the arms are in a common plane with one another. These projections extend short of the tips of the arms, with the projections diverging from one another towards the tips of the arms for receiving between them an item to be held by the holder according to the invention.

BRIEF DESCRIPTION OF THE DRAWINGS

FIG. 1 is a perspective view of a first embodiment of a nut, bolt, and screw holder according to the present invention.

FIG. 2 is a top plan view showing the holder of FIG. 1.

FIG. 3 is a side elevational view, partly cut away and in section, showing the manner in which the holder of FIGS. 1 and 2 is mounted on a finger of a person using the holder.

FIG. 4 is a fragmentary, perspective view, similar to the left front portion of FIG. 1, showing a modified holding arrangement for use with a holder according to FIGS. 1 through 3.

FIG. 5 is a fragmentary, perspective view, similar to FIG. 4, but showing another modified holding arrangement for use with a holder according to FIGS. 1, 2, 3.

FIG. 6 is a fragmentary, prospective view, similar to FIGS. 4 and 5, but showing yet another modified holding arrangement for use with the holder of FIGS. 1 through 3.

FIG. 7 is a fragmentary, perspective view, similar to FIGS. 4, 5 and 6, but showing still another modified holding arrangement for use with the holder of FIGS. 1 through 3.

FIG. 8 is a perspective view showing a second embodiment of a nut, bolt and screw holder according to the present iuvention.

FIG. 9 is a top plan view showing the holder of FIG. 8.

FIG. 10 is a side elevational view showing the manner in which the holder of FIGS. 8 and 9 is arrangeable on the finger of a person using the holder.

DESCRIPTION OF THE PREFERRED EMBODIMENTS

Referring now more specifically to FIGS. 1 through 3 of the drawing, a nut, bolt and screw holder 110 according to the present invention is arrangeable on a finger 112 of a person using the holding tool. Holder 110 includes a support arrangement 114 for contacting, or engaging with, finger 112 along a longitudinal extent of finger 112, with a holding arrangement 116 being mounted on support arrangement 114 for selectively engaging an item 118, such as the illustrated bolt, and retaining the item 118 on support arrangement 114.

Support arrangement 114 includes a longitudinally extending, substantially rigid, member 120, and a finger engaging structure 122 provided on member 120 for cooperatively engaging with an associated finger 112 and removably retaining the member 120 on finger 112. Longitunally extending member 120 includes a first end 124 and a second end 126 spaced longitudinally from end 124. The holding arrangement 116 is arranged on member 120 at the first end 124. The finger engaging structure 122 includes a ring 128 pivotly mounted on member 120 as by the illustrated strap assembly 130 arranged adjacent to the second end 126 of member 120 for receiving a finger 112 on which holder 110 is to be mounted.

Longitudinally extending member 120 includes a first planar portion 132 and a second planar portion 134, each portion 132 and 134 lying in a respective plane parallel to but spaced from the plane of the other portion 134, 132. A web 136 connects portion 132 to portion 134, this web 136 being arranged adjacent to the first end 124 of member 120 and being provided with a finger-receiving opening 138. Holding arrangement 116 is attached to first planar portion 132, with the ring 128 being connected to and arranged for extending away from the second planar portion 134 towards the plane of the first planar portion 132.

As can be appreciated from FIG. 3, in particular, the combination of ring 128 and opening 138 cause member 120 to be retained on a finger 112 in such a manner as to permit the person on whose finger 112 holder 110 is mounted to manipulate holder 110 in an exact manner and facilitate placement of an item 118 being held by holder 110.

Holding arrangement 116 includes a substantially U-shaped resilient clip 140 comprising a pair of spaced, substantially parallel coextensive legs 142 and 144 arranged for gripping between them an item 118 to be held. Holding arrangement 116 further includes a piece 146 of solid, magnetic material connected to the first end 124 of member 120. Clip 140 can be retained on the first planar portion 132 of member 120 as by the illustrated screw 148 or in any other conventional manner. Clip 140 further includes a joining portion 150 connecting together legs 142 and 144 and attached to the piece 146 of magnetic material in peripheral conforming manner to the wedge-shaped piece 146, as perhaps best seen in FIG. 2, with legs 142 and 144 arranged extending away from member 120 in a direction parallel to the longitudinal extent of member 120.

Legs 142 and 144 are illustrated as being provided with bowed sections 152 arranged opposite one another as to conformingly engage with an item 118 to be retained. Further, a screw threaded hole 154 is advantageously provided in portion 132 of member 120 for permitting screw 148 to retain pieces 146 on member 120.

Referring now to FIG. 4 of the drawings, a holder 210 according to present invention is provided with a support arrangement 214 having provided thereon a holding arrangement 216. Support arrangement 214 includes a member 220 having a first end 224 illustrated. The latter forms a planar portion 232 connected to a web 236 provided with a finger-receiving opening 238. It is to be understood that the general construction of support arrangement 214 is similar to that of support arrangement 110. Holding arrangement 216 includes a recess 240 V-shaped in plan and having a substantially planar bottom surface 242. Recess 240 opens toward the first end 224 of member 220, with a pin 244 being mounted in and extending from bottom surface 242 of recess 240. A clip 246 is disposed on pin 244 within recess 240, with clip 246 being provided with a pair of coextensive legs 248 and 250 arranged extending relative to member 220 in a manner similar to legs 142 and 144 of holder 110. It must be understood that clip 246 can be affixed to pin 244 in any suitable, known manner.

FIG. 5 of the drawings illustrates a holder 310 according to the invention which includes a support arrangement 314 and a holding arrangement 316. Support arrangement comprises a member 320 having a first longitudinal end 324 formed by a planar portion 332 connected to a web 336 provided with a finger-receiving opening 338. Extending from planar portion 332 is a pin 340 on which is mounted, in a manner similar to that of clip 246, a clip 342 provided with a pair of co-extensive legs 344 and 346. Each of the legs 344 and 346 is provided with an extension 348 and 350, rigidly attached to the associated legs 344 and 346 and extending away therefrom from a point adjacent to pin 340 for permitting legs 344 and 346 to be moved away from one another by forcing the extensions 348, 350 toward one another as by pincing the extensions 348 and 350 between one's fingers and thumb in a well known manner, not shown, in order to facilitate placement between and removal from the legs 344 and 346 an item to be held.

Referring now more particularly to FIG. 6 of the drawings, a holder 410 according to the invention includes a support arrangement 414 and a holding arrangement 416, with support arrangement 414 comprising a longitudinally exending member 420 having, as the support arrangement discussed above, an end 424 formed by a planar portion 432 connected to a web 436 provided with an opening 438. Holding means 416 includes a notch 440 provided in a 424 of member 420, the notch 440 lying in the plane of portion 434 and being substantially V-shaped and opening divergently toward end 424 of member 420 for receiving an item to be held by holder 410. Notch 440 is formed by a plurality of sets 442 of opposed arcs, and radiuses of the arcs of each of the sets 442 being less than the radius of the arcs of the one of the sets 442 immediately adjacent thereto in the direction towards the diverging opening of the notch 440.

FIG. 7 of the drawing discloses a holder 510 including a support arrangement 514 and the holding arrangement 516, with support arrangement 514 comprising a longitudinally extending member 527 having an end 524 formed by a planar portion 532 connected to a web 536 provided with an opening 538 arranged for receiving a finger on which holder 510 is to be mounted. Holding arrangement 516 includes a notch 540 provided in end 524 of planar portion 532 of member 520, the notch 540 lying in the plane of portion 532 and being substantially V-shaped in plan and opening divergently toward end 524 of member 520 for receiving an item to be held. Holding arrangement 516 further includes a guideway 542 of substantially V-shape in plan and disposed on the planar portion 532 in conformance with notch 540 and extending therefrom, guideway 542 including a pair of right angles 544 and 546 each having a rail 548 extending perpendicularly to the plane of planar portion 532 of member 520 and a further rail 550 extending substantially parallel to the plane of portion 532, spaced therefrom, and toward the other further rail 550. In this manner, angle 544 and 546 form a chamber 552, due to the spacing of rails 550 from the surface of planar portion 532, which chamber 552 is slightly wider in the direction parallel to the plane of portion 532 then the notch 540, so as to form a T-shaped receiving area in transverse section to the plane of portion 532 for receiving and retaining an item to be held by holder 510.

Referring now more particularly to FIGS. 8 through 10 of the drawings, there is illustrated a nut, bolt, and screw holder 1010 in accordance with the present invention. Holder 1010 is shown in FIG. 10 is arranged on a finger 1012 so as to permit finger 1012 to manipulate the holder 1010. The latter includes a support arrangement 1014 for engaging with finger 1012 along the longitudinal extent of the finger 1012. Holder 1010 also includes a holding arrangement 1016 mounted on the support arrangement 1014 collectively engaging in item 1018, such as the illustrated bolt, and retaining 1018 on support arrangement 1014. Support arrangement 1014 iucludes a longitudinal extending member 1020, and a finger engaging structure 1022 provided on member 1020 for cooperatively engaging with an associated finger 1012 and removably retaining member 1020 on finger 1012. Longitudinally extending member 1020 includes a first end 1024 and a second end 1026 spaced longitudinally from end 1024. Holding arrangement 1016 is arranged on member 1020 at first end 1024. The finger engaging structure 1022 includes a ring 1028 pivotally mounted on the member adjacent to the second end 1026 of member 1020, with ring 1028 being arranged for receiving the finger 1012 on which holder 1010 is to be mounted. Ring 1028 is mounted on member 1020 in a suitable manner, such as by use of the opposed openings 1030 as illustrated so as to permit ring 1028 to pivot about an axis transverse to the longitudinal extent of member 1020.

Member 1020 includes a first portion 1032, a second portion 1034 and a third portion 1036 exposed between and connected to portions 1032 and 1034. Holding arrangement 1016 is provided on first portion 1032, and ring 1028 is exposed on the second portion 1034. A window 1038 is provided in such a portion 1034 for a purpose which will be completed below. A longitudinally extended member 1020 is rigid in construction, with it being possible to construct member 1020 from any suitable materials, such as a metal, a synthetic resin, and the like, and the member 1020 has a curved cross section perpendicular to the longitudinal extent of member 1020 for conformingly engaging with a lower surface portion 1040 of finger 1012, such that member 1020 is contoured longitudinally to the finger 1012. Portion 1034 of member 1020 is flared away from the adjacent portion of finger 1012, and the associated arm of the associated hand, and for purposes of conformity as window 1038 is provided, and is engageable with the first phalanx 1042 of finger 1012 proceeding distally. The portion 1036 is engageable with the second phalanx 1044 of finger 1012, and the first portion 1032 of member 1020 is engageable with the adjacent surface of a third phalanx 1046, or tip of, finger 1012.

Holding arrangement 1016 includes a pair of coextensive arms 1048 and 1050 extending longitudinally to the longitudinal extent of member 1020, each of the arms 1048 and 1050 terminating in a tip 1052 and 1054, respectively, disposed transversely at the longitudinal extent of 1020 and extending towards the tip 1054, 1052 of the other of the arms 1050, 1048. The tips 1052 and 1054 each terminate in a substantially V-shaped indentation 1056 opening toward the tip 1054 and 1052 of the other of the arms 1050, 1048 for receiving an item therebetween to be held by the holder 1016. A pair of coextensive projections 1058 and 1060 extend codirectly with and are disposed between the arms 1048 and 1050, with each projection 1058, 1060 extending short of the tips 1052 and 1054 of the arms 1048 and 1050. The projections 1058 and 1060 diverge from one another toward the tips 1052, 1054 of the arms 1048, 1050 for receiving therebetween an item 1018 to be held by the holder 1010.

As can be readily understood from the above description and from the drawings, a nut, bolt, and screw holder according to present invention provides a finger-manipulated tool of simple, yet reliable, construction which can be easily used to properly position various kinds of fasteners in accessible locations, as well as to hold such items in place during removal of a cooperating item therefrom.

It is to be understood that the above description of the present invention is capable of various changes, modifications, and adaptations, and such are intended to be included within the meaning and range of equivalence of the following claims.

I claim:

1. A nut, bolt, and screw holder arranged for being mounted on a finger of a user of the holder, the finger having a longitudinal extent, the holder comprising, in combination:

(a) support means for contacting a finger along the longitudinal extent of the finger and being removably retained on the finger; and (b) holding means mounted on the support means for selectively engaging an item to be held and retaining the item on the support means, the support means including a longitudinally extending member, and finger engaging means provided on the member for cooperatively engaging with an associated finger and removably retaining the member on the finger, the longitudinally extending member including a first end and a second end spaced longitudinally from the first end, the holding means being arranged on the member at the first end, and the finger engaging means including a ring pivotally mounted on the member adjacent to the second end of the member, the ring being arranged for receiving a finger on which the holder is to be mounted.

2. A structure as defined in claim 1, wherein the longitudinally extending member includes a first planar portion and a second planar portion, each portion lying in a respective plane parallel to but spaced from the plane of the other portion, and a web connecting the first portion to the second portion, the web being arranged adjacent the first end of the longitudinally extending member and being provided with a finger-receiving opening, the opening being attached to the first planar portion, with the ring being connected to and arranged for extending away from the second planar portion towards the plane of the first planar portion.

3. A structure as defined in claim 1, wherein the holding means includes a substantially U-shaped, resilient clip comprising a pair of spaced, substantially parallel, coextensive legs arranged for gripping between them an item to be held by the holder.

4. A structure as defined in claim 3, wherein the holding means further includes a piece of solid, magnetic material connected to the first end of the longitudinally extending member, the resilient clip further including a joining portion connecting together the legs of the clip, the joining portion being attached to the piece of magnetic material by peripheral conformance therewith, with the legs of the clip extending away from the longitudinally extending member in a direction substantially parallel to the longitudinal extent of the longitudinally extended member.

5. A structure as defined in claim 3, wherein the holding means further includes a pin mounted on the longitudinally extending member and disposed extending perpendicular to the plane of the first portion of the longitudinally extending member, the resilient clip being mounted on the pin, with the legs of the clip extending away from the longitudinal extending member in a direction substantially parallel to the longitudinal extent of the member.

6. A structure as defined in claim 5, wherein the first portion of the longitudinally extending member is provided with a recess V-shaped in plan, having a substantially planar bottom surface, and opening toward the first end of the longitudinal extending member, the pin being mounted on and arranged extending from the bottom surface of the recess, the clip being disposed on the pin within the recess.

7. A structure as defined in claim 5, wherein the resilient clip further includes a first extension and a second extension, one extension being rigidly attached to one of the legs of the clip and the second extension being rigidly attached to the other of the legs of the clip, each extension extending away from the legs of the base of the pin for permitting the legs to be moved away from one another by forcing each extension toward one another.

8. A structure as defined in claim 1, wherein the holding means includes a notch provided in the first end of the longitudinally extending member, the notch lying in the plane of the first portion of the member and being substantially V-shaped and opening divergently toward the first end of the member for receiving an item to be held by the holder.

9. A structure as defined in claim 8, wherein the notch is formed by a plurality of sets of opposed arcs, the radiuses of the arcs of each of the sets being less than the radius of the arcs of the one of the sets immediately adjacent thereto in the direction toward the opening of the notch.

10. A structure as defined in claim 8, wherein the holding means further includes a guideway of substantially V-shape in plan and disposed on the first planar portion in conformance with the notch and extending toward the plane of the second portion of the longitudinally extending member, the guideway including a pair of right angles each including a rail extending substantially perpendicular to the plane of the first portion of the longitudinally extending member, and a further rail extending substantially parallel to the plane of the first portion of the longitudinally extending member, and spaced therefrom, and extending toward the other further rail, the angles forming a chamber slightly wider in the plane of the first portion of the longitudinally extending member than the width of the notch at a corresponding point on the longitudinal extent of the member and forming a T-shaped receiving area in transverse section to the plane of the first portion of the member for receiving an item to be held by the holder.

11. A structure as defined in claim 1, wherein the longitudinally extending member includes a first portion, a second portion, and a third portion disposed between and connected to the first and second portion, with the holding means being provided on the first portion, and the ring being provided on the second portion of the member.

12. A structure as defined in claim 11, wherein the longitudinally extending member is rigid and has a curved cross section perpendicular to the longitudinal extent of the member for conformingly engaging with a lower surface portion of an associated finger, the member being contoured longitudinally to the finger, the second portion of the longitudinally extending member being flared away from the adjacent third portion and engageable with the first phalanx of the finger proceeding distally, the third portion being engageable with a second phalanx of the finger, and the first portion being engageable with a third phalanx of the finger.

13. A structure as defined in claim 1, wherein the holding means includes a substantially U-shaped resilient clip comprising a pair of spaced, substantially parallel, coextensive legs arranged for gripping between them an item to be held by the holder.

14. A structure as defined in claim 1, wherein the holding means includes a notch provided in the support means, the notch being substantially V-shaped and opening divergently toward and a portion of the support means for receiving an item to be held by the holder.

15. A nut, bolt, and screw holder arranged for being mounted on a finger of a user of the holder, the finger having a longitudinal extent, the holder comprising, in combination:

(a) support means for contacting and being removably retained on the finger; and (b) holding means mounted on the support means for selectively engaging an item to be held and retaining the item on the support means, the holding means including a pair of arms extending longitudinally away from the support means, each of the arms terminating in tips disposed transversely of the longitudinal extent of the arms and toward the tip of the other of the arms, the tips each terminating in a V-shaped indentation opening toward the tip of the other of the arms for receiving there between an item to be held, and a pair of coextensive projections extending codirectionally with and disposed between the arms and extending short of the tips of the arms, the projections diverging from one another toward the tips of the arms for receiving between them an item to be held which is different from the item held by the arms.

16. A structure as defined in claim 15, wherein the support means includes a longitudinally extending member, and finger engaging means provided on the member for cooperatively engaging with an associated finger and removably retaining the member on the finger.

17. A nut, bolt, and screw holder arranged for being mounted on a finger of a user of the holder, the finger having a longitudinal extent, the holder comprising, in combination:

(a) support means for contacting a finger along the longitudinal extent of the finger and being removably retained on the finger; and (b) holding means mounted on the support means for selectively engaging an item to be held and retaining the item on the support means, the support means including a longitudinally extending member, and finger engaging means provided on the member for cooperatively engaging with an associated finger and removably retaining the member on the finger, the longitudinally extending member including a first end and a second end spaced longitudinally from the first end, the holding means being arranged on the member at the first end, and the finger engaging means including a ring pivotally mounted on the member adjacent to the second end of the member, the ring being arranged for receiving a finger on which the holder is to be mounted, the longitudinally extending member including a first portion, a second portion, and a third portion disposed between and connected to the first and second portion, with the holding means being provided on the first portion, and the ring being provided on the second portion of the member, the holding means including a pair of arms extending longitudinally of the longitudinal extent of the longitudinally extending member, each of the arms terminating in a tip disposed transversely of the longitudinal extent of the member and toward the tip of the other of the arms, the tips each terminating in a V-shaped indentation opening toward the tip of the other of the arms for receiving an item to be held between them, and a pair of co-extensive projections extending codirectionally with and disposed between the arms and extending short of the tips of the arms, with the projections diverging from one another towards the tips of the arms, with the projections diverging from one another towards the tips of the arms for receiving between them an item to be held by the holder.

* * * * *